United States Patent [19]

Schumacher

[11] Patent Number: 4,465,083

[45] Date of Patent: Aug. 14, 1984

[54] TRANSFER APPARATUS FOR CIGARETTES OR THE LIKE

[75] Inventor: Peter Schumacher, Hamburg, Fed. Rep. of Germany

[73] Assignee: Hauni-Werke Körber & Co. K.G., Hamburg, Fed. Rep. of Germany

[21] Appl. No.: 271,834

[22] Filed: Jun. 9, 1981

[30] Foreign Application Priority Data

Jun. 19, 1980 [DE] Fed. Rep. of Germany ..... 3022885

[51] Int. Cl.[3] ..... A24C 5/00; A24C 5/32; A24C 5/33; A24C 5/35

[52] U.S. Cl. ..... 131/282; 131/283

[58] Field of Search ..... 131/282, 283; 198/393, 198/498

*Primary Examiner*—V. Millin

*Attorney, Agent, or Firm*—Peter K. Kontler

[57] ABSTRACT

An apparatus for transfer of successive cigarettes which are delivered seriatim to a first station by moving them axially to a second station from which the cigarettes are removed by advancing them sideways has a planetary transmission with a rotary planet carrier for a set of equidistant planet pinions each connected to a hollow crank arm for a discrete article receiving device. The pinions are rotated by a stationary sun gear when the carrier is driven whereby the receiving devices travel along an endless path a portion of which extends between the first and second stations. The receiving devices are held against changes in orientation during travel along the endless path by crank units and torque transmitting units. The crank units are turned back and forth by a driven holder which indirectly rotates the carrier through the medium of the crank units, and each crank unit rotates the corresponding torque transmitting unit which latter is connected to and turns the corresponding receiving device. The torque transmitting units are installed in the interior of the respective crank arms and each thereof has a cardanic shaft one end portion of which is connected with the corresponding crank unit by a first universal joint and the other end portion of which is connected to the respective receiving device by a second universal joint.

5 Claims, 3 Drawing Figures

TRANSFER APPARATUS FOR CIGARETTES OR THE LIKE

BACKGROUND OF THE INVENTION

The present invention relates to apparatus for transferring cigarettes, filter rod sections or similar rod-shaped articles which constitute or form part of smokers' products between a first station where the articles advance axially at a first speed and a second station where the articles advance sideways (at right angles to their axes) at a different second speed. More particularly, the invention relates to improvements in transfer apparatus of the type wherein a planetary transmission is or can be utilized to cause suction-operated or otherwise actuated receiving means for rod-shaped articles to advance along an endless path a first portion of which is adjacent to the first station and a second portion of which is adjacent to the second station. Still more particularly, the invention relates to improvements in apparatus wherein the planetary transmission comprises a rotary carrier for a set of planet pinions each of which transmits torque to a discrete crank arm and each crank arm supports a discrete receiving means. The planet pinions are rotated by a sun gear when the carrier is set in rotary motion. As a rule, apparatus of the above outlined character are further provided with means for preventing changes in orientation of the receiving means, at least during certain stages of travel of receiving means along their endless path. This should ensure that each receiving means invariably accepts one or more articles upon arrival at one of the stations and invariably delivers articles in optimum orientation to a conveyor or the like at the other of the two stations.

Transfer apparatus of the above outlined character are often installed between a producing machine (e.g., a cigarette maker) and a processing machine, such as a filter tipping machine. Reference may be had to U.S. Pat. No. 3,303,926 granted Feb. 14, 1967 to Ernest E. Pohl, U.S. Pat. No. 3,567,011 granted Mar. 2, 1971 to Jesse R. Pinkham, German Utility Model No. 1,972,850 and commonly owned U.S. Pat. No. 4,051,947 granted Oct. 4, 1977 to Peter Schumacher et al. The disclosures of these patents are incorporated herein by reference. The receiving means which are utilized in the patented apparatus normally serve to transfer rod-shaped articles from a first station where the articles move axially to a second station where the articles move sideways, i.e., to convert a file of coaxial articles into a row of parallel articles. Such mode of transferring entails a substantial reduction in the speed of movement of articles. The receiving means travel along epicycloidal or elliptical paths and the apparatus comprise two planetaries for each and every receiving means, namely, a first planetary which causes the respective receiving means to travel along an epicycloidal or elliptical path and a second planetary which ensures that the orientation of receiving means remains unchanged, at least during certain stages of movement along the epicycloidal or elliptical path. The number of gears and pinions is very substantial; this contributes to the bulk and cost of the apparatus and necessitates frequent repairs and/or replacements because the gears are subjected to extensive wear, especially when the apparatus is to transfer rod-shaped articles between a mass-producing machine and a machine which can process many thousands of articles per minute. The maxiumum output of a modern cigarette maker is in excess of 100 cigarettes per second.

Moreover, the numerous gears generate a substantial amount of noise which affects the efficiency and well being of attendants. It has been found that even a new planetary is likely to permit the receiving means to move with a certain amount of play so that the orientation of receiving means which are controlled by planetaries is not satisfactory, especially when the articles must be transferred at extremely short intervals.

The apparatus which is disclosed in the aforementioned commonly owned U.S. Pat. No. 4,051,947 constitutes a substantial improvement over the earlier apparatus because the number of gears which are utilized therein is relatively low; nevertheless, the apparatus of Schumacher et al. still employs two planetaries for each and every receiving means.

OBJECTS AND SUMMARY OF THE INVENTION

An object of the invention is to provide a novel and improved transfer apparatus for cigarettes or analogous rod-shaped articles which is simpler, less expensive and less prone to malfunction but more reliable and quieter than heretofore known transfer apparatus.

Another object of the invention is to provide a transfer apparatus which need not employ two discrete planetary transmissions for each and every article receiving device.

A further object of the invention is to provide a transfer apparatus wherein the number of gears is a small fraction of the number of such components in conventional transfer apparatus.

An additional object of the invention is to provide a transfer apparatus which can be installed between a modern cigarette maker or a like mass producing machine and a modern high-speed processing machine for cigarettes and/or other rod-shaped commodities.

A further object of the invention is to provide the transfer apparatus with novel and improved means for preventing undesirable changes in orientation of article receiving means during transport of articles between two spaced-apart stations at one of which the articles advance axially at a first speed and at the other of which the articles advance sideways at a different second speed.

Another object of the invention is to provide the apparatus with novel and improved means for moving the receiving means along an endless path a portion of which extends between the two stations.

An ancillary object of the invention is to provide a transfer apparatus which treats the articles gently and which can be designed with a view to reduce or eliminate the effect of forces which tend to or actually adversely affect the appearance and/or other desirable characteristics of articles in heretofore known transfer apparatus.

The invention resides in the provision of an apparatus for transferring cigarettes or analogous rod-shaped articles between a first station at which the articles move axially at a first speed and a second station at which the articles move sideways at a different second speed. The apparatus comprises a plurality of article receiving devices, means for moving the receiving devices along an endless path (preferably along a substantially elliptical path) a portion of which extends from one of the stations to the other of the stations so that the receiving devices can accept articles at the one station and deliver the articles to the other station, and means for preventing changes in orientation of receiving devices, at least during travel of receiving devices along the aforementioned portion of the endless path. One of the two means comprises at least one planetary transmission and the other of the two means comprises at least one crank unit.

In accordance with a presently preferred embodiment of the invention, the one means is the moving means and the transmission comprises a preferably stationary sun gear, a rotary planet carrier, and a plurality of planet pinions rotatably supported by the planet carrier and each arranged to move one of the receiving devices in response to rotation of the carrier with reference to the sun gear. The means for preventing changes in orientation of receiving devices preferably comprises a discrete crank unit for each of the receiving devices, and such means preferably further comprises a discrete torque transmitting unit between each of the crank units and the respective receiving device. Furthermore, the apparatus preferably further comprises a discrete crank arm for each receiving device. The crank arms are rotated by the respective planet pinions and rotatably support the corresponding receiving devices so that the receiving devices can be moved closer to or further away from the axis of the planet carrier in response to orbiting of the crank arms about the axis of the carrier and that the crank units can rotate the respective receiving devices with reference to the corresponding crank arms.

The planetary transmission may comprise at least one additional gear which is interposed between the sun gear and the planet pinions.

Still further, the means for preventing changes in orientation of receiving devices comprises means for orbiting the crank units about the axis of the planet carrier, and each of the crank units then preferably comprises a crank pin which is rotatably mounted in the planet carrier so that the carrier is set in rotary motion in response to orbiting of the crank pins. The axes of all planet pinions are preferably disposed at the same distance from the axis of the planet carrier, i.e., such axes may form a circle whose center is located on the axis of the planet carrier. The receiving devices are rotatable in their crank arms about axes which are parallel to the axes of the respective planet pinions, i.e., the receiving devices are eccentric with reference to the associated planet pinions.

More specifically, the presently preferred embodiment of the means for preventing changes in orientation of receiving devices comprises a discrete crank unit for each receiving device, a shaft for each receiving device, and a discrete torque transmitting unit for each shaft. The shafts are coaxial with the corresponding planet pinions (for example, each planet pinion can constitute an external gear on a tubular element which is rotatable in the planet carrier and rotatably surrounds the corresponding shaft). Each crank unit comprises a first crank pin which is coaxial with and serves to rotate the respective shaft, a second crank pin which is eccentric to the first crank pin, and a crank arm between the first and second crank pins. The first crank pins are rotatably journalled in the planet carrier and the means for preventing changes in orientation of receiving devices preferably further comprises means (e.g., a rotary holder which is eccentric to the planet carrier and is driven by the prime mover of a machine serving to supply articles to the one station so as to orbit the second crank pins and to thereby rotate the planet carrier relative to the sun gear) for orbiting the second crank pins about the axis of the planet carrier. Each of the torque transmitting units connects the respective shaft with the corresponding receiving device so that the latter is rotatable with reference to the corresponding planet pinion.

The first mentioned crank arms are preferably hollow levers which are driven by the planet pinions and rotatably support the corresponding receiving devices.

The torque transmitting units are preferably installed in the interior of the respective hollow levers, and each such torque transmitting unit may comprise a first universal joint receiving torque from the corresponding shaft, a second universal joint which drives the corresponding receiving device, and a cardanic shaft between the two universal joints.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
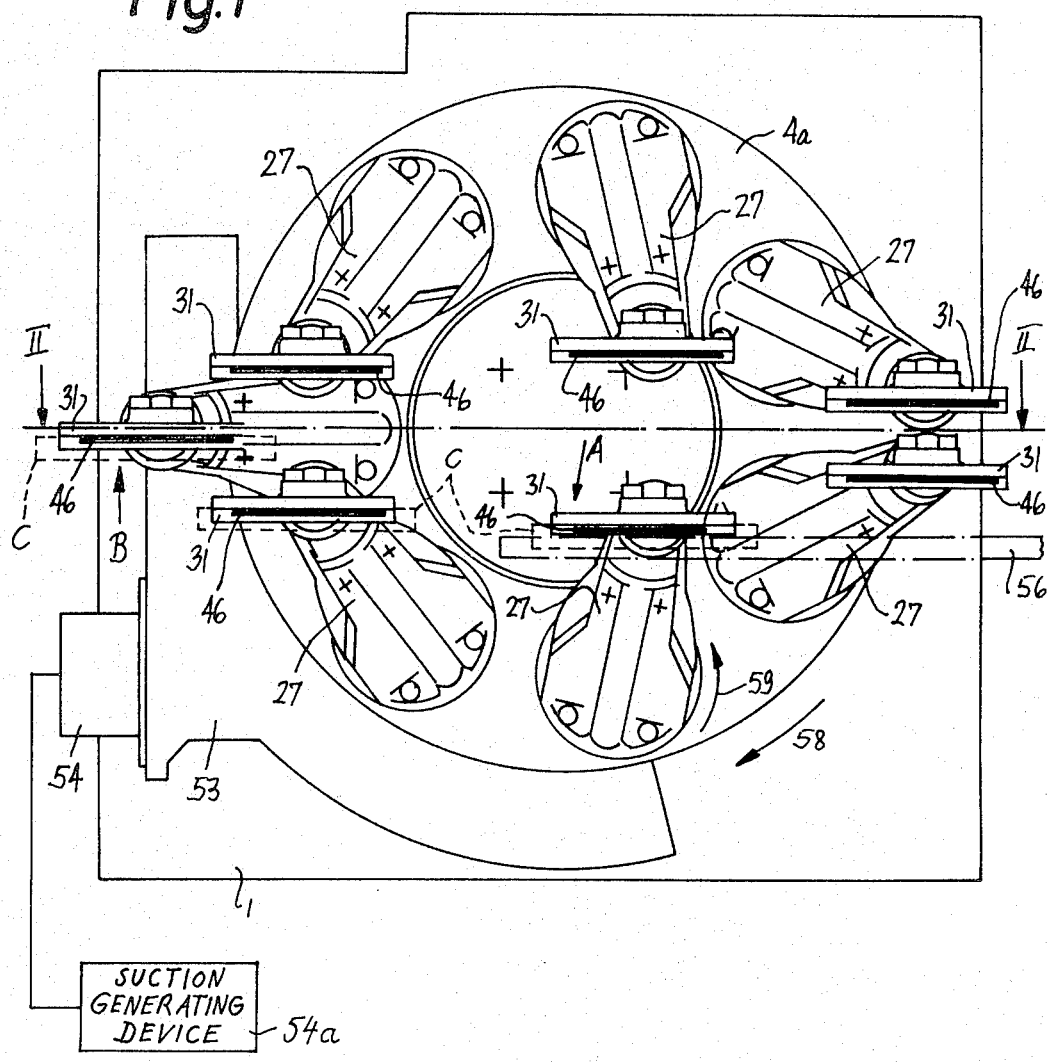
FIG. 1 is a schematic elevational view of a transfer apparatus which embodies the present invention, the apparatus being provided with seven article receiving means.
Figure 2:
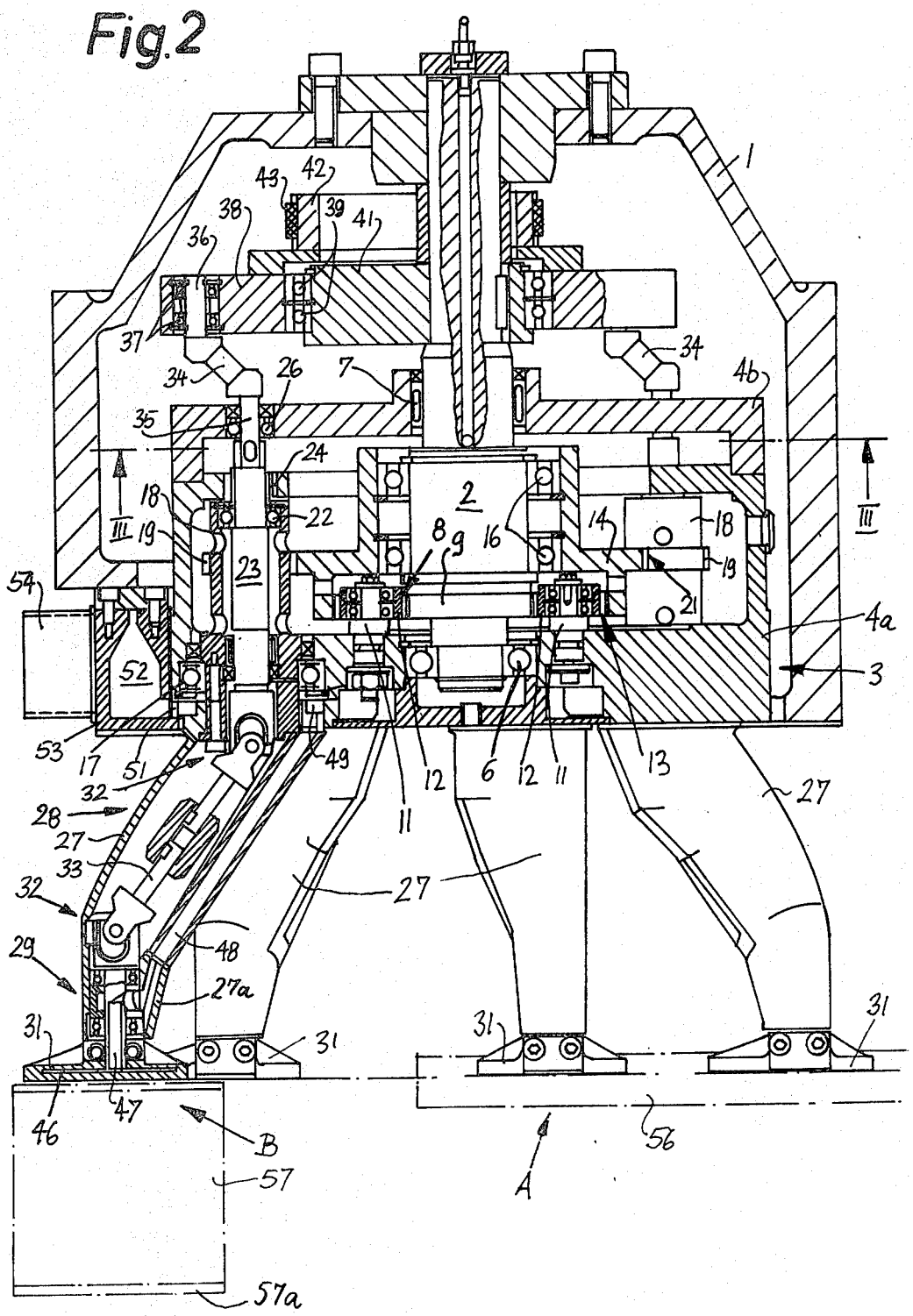
FIG. 2 is a sectional view as seen in the direction of arrows from the line II—II of FIG. 1.
Figure 3:
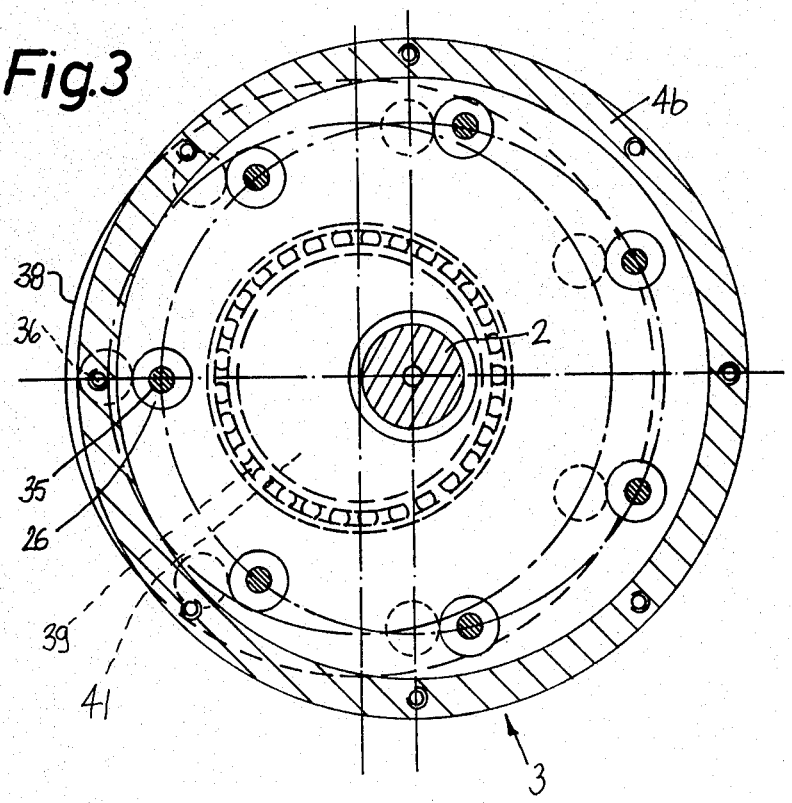
FIG. 3 is a sectional view as seen in the direction of arrows from the line III—III of FIG. 2.

The transfer apparatus which is shown in FIGS. 1 to 3 comprises a stationary housing or frame 1 for a shaft 2 which is fixedly secured thereto and defines an axis of rotation for a composite hollow planet carrier 3 having a cupped first section 4*a* and a cupped second section 4*b*. The section 4*a* is rotatably mounted on a ball bearing 6 which surrounds the lower end portion of the shaft 2, as viewed in FIG. 2, and the section 4*b* is mounted on a needle bearing 7 surrounding an intermediate portion of the shaft 2. The latter is integral with or is rigidly connected to a coaxial stationary sun gear 9 having an annulus of external teeth 8.

The section 4*a* of the carrier 3 rotatably supports two shafts 11 which are parallel to the shaft 2 and are located diametrically opposite each other with reference to the sun gear 9. The shafts 11 carry intermediate pinions 12 which mate with the sun gear 9 as well as with the internal gear 13 of a ring-shaped member 14; the latter is rotatable on two ball bearings 16 which surround the shaft 2. The section 4*a* of the carrier 3 has seven parallel bores or holes for discrete tubular elements or sleeves 18 whose axes are disposed at the same distance from the axis of the shaft 2 and which are surrounded by ball bearings 17 mounted in the section 4*a*. Each of the sleeves 18 has an external gear 19 constituting a planet pinion indirectly meshing with the sun gear 9 by way of an external gear 21 on the ring-shaped member 14, the aforementioned internal gear 13 and the intermediate pinions 12.

Each of the sleeves 18 is coaxial with a discrete shaft 23 and is rotatably mounted thereon by means of at least one further ball bearing 22 or another suitable antifriction bearing. The shafts 23 are rotatably mounted in needle bearings 24 which are installed in the section 4*a*. Furthermore, each of the sleeves 18 is rigidly connected with a hollow crank arm 28 or lever resembling a dog's leg and having a first portion 27 which is rigidly connected to or made integral with the corresponding sleeve 18 and a second portion 27*a* including an end portion or head 29 which rotatably surrounds a receiving means 31 for one or more cigarettes C, e.g., for one cigarette of double unit length.

In accordance with a feature of the invention, the receiving means 31 are held against changes in orientation during movement from a first station A (where their elongated flutes receive cigarettes C from a maker) to a second station B (where the cigarettes C are deposited in successive flutes 57*a* of a rotary drum-shaped removing conveyor 57) by a novel system for preventing changes in orientation and including a discrete torque transmitting unit between each shaft 23 and the respective receiving means 31. Each such torque transmitting unit includes a first universal joint 32 at the lower end of the respective shaft 23 (as viewed in FIG. 2), a second universal joint 32 at the head 29 of the respective crank arm portion 27*a*, and a preferably adjustable cardanic shaft 33 between the two universal joints. The shafts 23 are rotatable with reference to the carrier 3 and the respective sleeves 18 by crank units each of which includes a first crank pin 35 coaxial with the corresponding shaft 23, a second crank pin 36 which is eccentric to the crank pin 35, and a crank arm 34 between the crank pins 35, 36. The crank pins 35 are rotatable in ball bearings 26 installed in the section 4*b*, and the crank pins 36 are rotatable in pairs of ball bearings 37 provided in an annular disc-shaped holder 38 which is eccentric with reference to the carrier 3. The means for rotatably mounting the holder 38 on the shaft 2 comprises a ring-shaped support 41 whose eccentricity with reference to the shaft 2 matches the distance between the axes of two associated crank pins 35, 36. The holder 38 is rotatable on a pair of ball bearings 39 which surround the support 41; the latter is affixed to the shaft 2 and/or housing 1. The holder 38 can be rotated by the main prime mover of the machine which supplies the cigarettes C. The main prime mover drives an endless toothed belt conveyor 43 which is trained over a sprocket wheel 42, and the sprocket wheel 42 is separably or more or less permanently secured to the holder 38. The holder 38 drives the carrier 3 through the medium of crank units including the crank arms 34 and crank pins 35, 36.

In the illustrated embodiment, the ratio of the sun gear 9 to the pinions 12 is two-to-one; the ratio of pinions 12 to the internal gear 13 is one-to-four; and the ratio of external gear 21 to the planet pinions 19 is four-to-one.

The shafts 23 may but need not be integral with the respective crank pins 35; all that counts is to ensure that the shafts 23 rotate in response to rotation of the corresponding crank pins 35.

The receiving means 31 are provided with pneumatically operated means for attracting cigarettes C during transport from an elongated trough-shaped guide member 56 of the cigarette rod making machine to the flutes 57*a* of the conveyor 57. Such attracting means includes elongated slits or ports 46 in the receiving means 31 and channels 47 communicating with such ports as well as with channels 48 in the respective crank arms 28. The upper end portions of the channels 48, as viewed in FIG. 2, communicate with annular chambers 49 which may constitute parts of the aforementioned bores or holes for the sleeves 18 in the carrier section 4*a*. The section 4*a* has openings 51 which connect the chambers 49 with a suction chamber 52 provided in a valving element 53 which is secured to the housing 1 and extends between the stations A and B. The suction chamber 52 is connected with a suction generating device 54*a* (e.g., a suitable fan) by a suction pipe or hose 54. The arrangement is such that the device 54*a* draws air from the ports 46 of those receiving means 31 which carry cigarettes C from the station A toward the station B and which are about to arrive at the station A in order to remove cigarettes C from the guide 56. The guide 56 advances the cigarettes axially and at a relatively high speed, and the flutes 57*a* of the conveyor 57 remove cigarettes C by moving them sideways at a relatively low speed.

The operation of the improved apparatus is as follows:

When the cigarette rod making machine is in use, it supplies a file of cigarettes C to the guide 56 and its prime mover drives the belt conveyor 43 so that the latter rotates the holder 38 through the medium of the sprocket wheel 42. The direction in which the holder 38 is rotated is indicated by the arrow 58 shown in FIG. 1. The holder 38 rotates the carrier 3 (i.e., the sections 4*a* and 4*b* which are connected to each other) through the medium of crank units including the cranks arms 34 and crank pins 35, 36, i.e., the carrier 3 also rotates in the direction indicated by the arrow 56. The intermediate pinions 12 thereby roll along the stationary sun gear 9 and cause the ring-shaped member 14 to rotate in the direction of the arrow 58. It will be recalled that the pinions 12 mate with the internal gear 13 of the member 14. The planet pinions 19 on the sleeves 18 mate with the external gear 21 of the ring-shaped member 14 whereby each crank arm 28 (and hence the corresponding receiving means 31) completes two revolutions in the direction of arrow 59 (FIG. 1) in response to each complete revolution of the carrier 3 in the direction of arrow 58. This will be readily appreciated by taking into consideration the aforementioned ratios of the various gears in the illustrated planetary transmission. However, and since the carrier 3 rotates counter to the direction of rotation of crank arms 28 about the axes of the respective sleeves 18, the sum total of rotation of each receiving means 31 is one revolution owing to superimposition of movement of the carrier 3 upon the movements of crank arms 28. The crank arms 34 thereby hold the receiving means 31 against changes in orientation because such crank arms 34 are connected to the associated receiving means 31 through the medium of the corresponding crank pins 35, shafts 23, univeral joints 32 and cardanic shafts 33. As shown in FIG. 1, the orientation of each receiving means 31 is the same, i.e., their flutes are always parallel to cigarettes C in the guide 56 and to the flutes 57*a* of the conveyor 57. FIG. 1 further shows that the receiving means 31 travel along an endless path which can be said to resemble a very flat ellipse with very small radii of curvature in the regions of the foci. In view of the superimposed angular movements, the tangential velocity of receiving means 31 is highest in those portions of the endless path which are nearest to the axis of the shaft 2. Inversely, the tangential velocity of receiving means 31 drops to a minimum value while such receiving means advance along those portions of their endless path which are remotest from the axis of the shaft 2. The guide 56 delivers successive cigarettes C substantially tangentially of the path for the receiving means 31. The tangential velocity of receiving means 31 at the station A is preferably rather high so as to ensure that a cigarette C which has been engaged and entrained by the oncoming receiving means 31 is moved away from the next-following cigarette C in the guide 56; this eliminates the possibility of interference between movements of successive articles C from the station A to the station B. In other words, a freshly engaged cigarette C moves axially or nearly axially and away from the cigarette C which is about to reach the station A. The axial velocity of cigarettes C decreases during transport toward the station B and is zero during or immediately after transfer into the oncoming flute 57*a* of the conveyor 57. The flutes 57*a* are or may be closely adjacent to each other. The speed of axial movement of cigarettes C at the station A is much higher than the speed of sidewise movement of cigarettes C away from the station B.

An important advantnge of the improved apparaus is that it is simpler, more compact and more reliable than heretofore known apparatus as well as that the path along which the receiving means 31 advance can be selected with a view to prevent the development of excessive forces which would interfere with orderly and predictable transfer of cigarettes C or analogous rod-shaped articles at a high frequency and without any damage to or deformation of the articles. This is attributable to the fact that the construction and mode of operation of the illustrated apparatus deviate from the construction and mode of operation of heretofore known apparatus (including those which are disclosed in the aforementioned prior art). In such conventional apparatus, a first planetary causes the receiving means to advance along an elliptical or epicycloidal path. Furthermore, such conventional apparatus employ additional planetaries to prevent changes in orientation of receiving means during travel along the elliptical path. Instead, it is now proposed to hold the receiving means 31 against changes in orientation by resorting to relatively simple and inexpensive crank units such as those composed of crank arms 34 and associated crank pins 35, 36. The mounting of various components of the means which prevents changes in orientation of receiving means 31 in ball bearings, needle bearings or other suitable antifriction bearings renders it possible to effectively eliminate undesirable play and to thus ensure extremely accurate and predictable retention of all receiving means in a selected orientation during each and every stage of travel along the endless path shown in FIG. 1. Moreover, such mounting of the means for preventing changes in orientation of the receiving means 31 entails a minimum of wear, i.e., the wear is much less pronounced than that upon the components of planetary transmissions or the like.

The provision of universal joints 32 and cardanic shaft 33 with suitable antifriction bearings for the receiving means 31 in the regions of the respective heads 29 (see FIG. 2) and for the associated sleeves 18 and shafts 23 also contributes to elimination or reduction of undesirable clearances and hence to more predictable orientation of receiving means 31 during each and every stage of their orbital movement about the axis of the shaft 2. The utilization of hollow crank arms 28 is desirable and advantageous because the mounting of parts 32, 33, 32 in the interior of the respective portions 27 and 27*a* contributes to compactness of the apparatus and reduces the likelihood of contamination of such parts when the apparatus is in use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for transferring cigarettes or analogous rod-shaped articles between a first station at which the articles move axially at a first speed and a second station at which the articles move sideways at a different second speed, comprising a plurality of article receiving devices; means for moving said devices along an endless path a portion of which extends from one of said stations to the other of said stations so that the devices can accept articles at said one station and deliver the articles to said other station, comprising at least one planetary transmission including a sun gear, a rotary planet carrier, a plurality of planet pinions rotatably supported by said carrier and each arranged to move one of said devices in response to rotation of said carrier with reference to said sun gear, and at least one gear interposed between said sun gear and said pinions, the axes of said pinions being equidistant from the axis of said carrier; a plurality of crank arms, one for each of said devices, each of said crank arms receiving torque from one of said planet pinions and rotatably supporting the respective device, said devices being rotatable in the respective crank arms about axes which are spaced apart from the axes of the respective pinions; means for preventing changes in orientation of said devices, at least druing travel along said portion of said path, comprising a discrete crank unit, a discrete shaft and a discrete torque transmitting unit for each of said devices, said torque transmitting units being disposed between said crank units and the respective devices, said shafts being coaxial with the respective pinions and each of said crank units comprising a first crank pin coaxial with and arranged to rotate the respective shaft, a second crank pin eccentric with reference to the first crank pin and a crank arm intermediate said crank pins, said first crank pins being rotatably journalled in said carrier; and means for orbiting said second crank pins about the axis of said carrier, each of said torque transmitting units connecting the respective shaft with the corresponding device so that the latter is rotatable with reference to the corresponding pinion.

2. The apparatus of claim 1, wherein said first named crank arms are hollow and each of said torque transmitting units is installed in the interior of the respective first named crank arm.

3. The apparatus of claim 2, wherein each of said torque transmiting units comprises a first universal joint driven by the respective shaft, a second universal joint driving the respective receiving device, and a cardanic shaft between said universal joints.

4. Apparatus for transferring cigarettes or analogous rod-shaped articles between a first station at which the articles move axially at a first speed and a second station at which the articles move sideways at a different second speed, comprising a plurality of article receiving devices; means for moving said devices along an endless path a portion of which extends from one of said stations to the other of said stations so that the devices can accept articles at said one station and deliver the articles to said other station, comprising at least one planetary transmission including a sun gear, a rotary planet carrier, a plurality of planet pinions rotatably supported by said carrier and each arranged to move one of said devices in response to rotation of said carrier with reference to said sun gear, and at least one drive means interposed between said sun gear and said pinions, the axes of said pinions being equidistant from the axis of said carrier; a plurality of arms, one for each of said devices, each of said arms receiving torque from one of said planet pinions and said devices being rotatable in the respective arms about axes which are spaced apart from the axes of the respective pinions; and means for preventing changes in orientation of said devices, at least during travel along said portion of said path, comprising a discrete crank unit for each of said devices, each of said crank units comprising a shaft rotatably mounted in the respective planet pinion.

5. The apparatus of claim 4, wherein said preventing means further comprises means for rotating said crank units about the respective shafts to thereby maintain the orientation of the respective devices unchanged during travel along said portion of said path.

* * * * *